United States Patent [19]

Okada

[11] Patent Number: 4,541,444

[45] Date of Patent: Sep. 17, 1985

[54] DEVICE FOR DETECTING THE AMOUNT OF COINS IN HOPPER DEVICE

[75] Inventor: Tomoo Okada, Tochigi, Japan

[73] Assignee: Kabushiki Kaisha Universal, Tochigi, Japan

[21] Appl. No.: 530,037

[22] Filed: Sep. 7, 1983

[30] Foreign Application Priority Data

Sep. 13, 1982 [JP] Japan ..... 57-158050

[51] Int. Cl.[4] ..... G07D 9/04

[52] U.S. Cl. ..... 133/4 A; 194/1 F

[58] Field of Search ..... 133/2, 4 A, 8 R; 194/10, DIG. 11, DIG. 14, 1 K, 1 F; 221/6, 14; 340/570, 617, 612

[56] References Cited

U.S. PATENT DOCUMENTS 3,950,653 4/1976 Kirkpatrick ..... 340/617

4,342,384 8/1982 Fukase et al. ..... 194/1 F

*Primary Examiner*—Stanley H. Tollberg

*Attorney, Agent, or Firm*—Young & Thompson

[57] ABSTRACT

A hopper device has an insulating hopper member. A first electrode is mounted in the inner side of the hopper member in a lowermost portion thereof, and at least one second electrode is mounted in the inner side of the hopper member in a portion thereof at a higher level than the first electrode. When coins having conductivity are collected in the hopper member until their level reaches the second electrode, the first and second electrodes are electrically coupled together by the coins, whereby an electric signal representing the amount of collected coins is generated.

7 Claims, 5 Drawing Figures

DEVICE FOR DETECTING THE AMOUNT OF COINS IN HOPPER DEVICE

BACKGROUND OF THE INVENTION

This invention relates to a hopper device for discharging coins (inclusive of tokens) and, more particularly, to a device for detecting the amount of coins accommodated in a hopper member in the hopper device.

In a game machine, e.g., a prize-winning game slot machine, a predetermined number of coins are paid out when a prize-winning combination of symbol patterns of a plurality of juxtaposed reels results. The coins are paid out from a hopper device. The hopper device consists of a rotatable scooping disc rotated from a motor and a hopper member accommodating the scooping member in a slightly inclined state. Coins accommodated in the hopper member are scooped up one by one by the scooping member, and the scooped coin can be led to a saucer for the pay-out. Coins inserted into the slot machine for starting games are collected in the hopper device through a chute communicating with a coin slot.

When coins paid out are more than the coins inserted into the slot machine, the hopper member eventually becomes empty of coins. Conversely, if more coins are inserted into the slot machine than the coins paid out, coins eventually overflow from the hopper member. Particularly, when a great number of coins are accommodated in the hopper member, the scooping disc experiences a great load on its front, which is undesired from the standpoint of the smooth rotation of the scooping member.

Where such a hopper device is used, therefore, it is necessary to frequently check the amount of coins in the hopper member. However, the hopper device is usually installed inside the body of a slot machine. The observation of the amount of accommodated coins, therefore, must be done by unlocking a front or back plate of the slot machine body. This operation is very cumbersome if there are a large number of slot machines installed.

OBJECTS OF THE INVENTION

The primary object of the invention is to provide a hopper device, which permits detection of the amount of coins accommodated in a hopper member.

Another object of the invention is to provide a hopper device, which is simple in construction.

A further object of the invention is to provide a hopper device, which can display whether the amount of accommodated coins is in a regular range.

A still further object of the invention is to provide a device, in which a switching plate provided in a chute coupling a coin slot and a hopper device is driven to a position in which coins are no longer led to the hopper device, when the capacity of the hopper device is reached.

SUMMARY OF THE INVENTION

The invention is predicated on the fact that coins or tokens are mostly made of metals such as iron and aluminum and have electrical conductivity, and the above objects of the invention are achieved by providing electrodes on the inner side of the hopper member accommodating coins or the like and using the accommodated coins or the like as a switch element. The detecting device thus consists merely of electrodes mounted in the hopper member and does not require any other complicated component. It is thus readily applicable to the conventional hopper device. Furthermore, a detection signal obtained from it can be used as a signal to display the amount of the accommodated coins. By so doing, the amount of accommodated coins can be displayed as an illuminated display which can be readily observed externally. This signal is also used to operate a switching plate disposed in a chute connecting the coin slot and hopper device. When the capacity of the hopper device is reached, the switching member is driven to a position in which subsequently inserted coins are no longer led to the hopper device but are led to a cash box.

DETAILED DESCRIPTION OF THE PREFERRED EMBODIMENT

Figure 1:
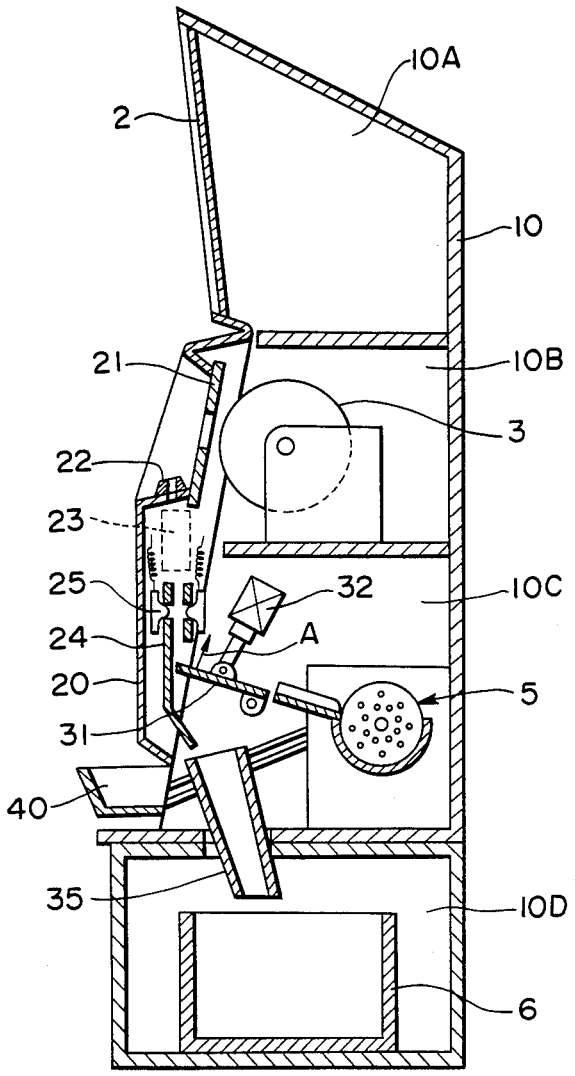
FIG. 1 is a schematic sectional view showing a slot machine embodying the invention.

FIG. 1 is a sectional view schematically showing a slot machine embodying the invention. There is shown a body 10 which has a display section 10A , a reel accomodating section 10B, a hopper accomodating section 10C, and a coin recovery section 10D. The display section 10A has a front display panel 2 and lamps (not shown) for illuminating the panel . The reel accomodating section 10B accomodates reels 3. The hopper accomodating section 10C accomodates a hopper 5 which has a function of detecting the quantity of coins contained in it. The coin recovery section 10D accomodates a cash box 7. A front plate 20 is hinged to the body 10 so that it can be opened and closed. It has a window 21, through which the reels are seen. The front plate 20 also has a coin slot 22 and a rejector 23. The rejector 23 checks each coin inserted from the coin slot 22 and rejects it if it is defective. The front plate 20 further has a chute 24 for guiding inserted coins along a predetermined path and a coin counter 25, consisting of a photosensor for instance, provided on the chute 24 at a suitable position thereof.

A switching plate 31 is pivotally supported at one end 31*a* and is pivotally movable in the direction of arrow A by a solenoid 32. When the switching plate 31 is in the illustrated position, coins inserted through the coin slot are collected in the hopper 5. When the displayed combination of symbol patterns of the reels 3 is a prize-winning combination, coins in number corresponding to the pertinent game points are paid out from the hopper into a saucer 40.

In the slot machine as described, when the hopper 5 becomes full of coins successively inserted through the coin slot 22, the solenoid 32 is actuated by a detection signal, whereby the switching plate 31 is pivotally moved in the direction of arrow A. Coins subsequently inserted are no longer supplied to the hopper 5 but are led through the chute 35 into the cash box 6. In this way, the overflow of coins from the hopper 5 can be prevented. When a certain amount of coins are paid out as the results of games, the detection signal from the hopper 5 disappears. As a result, the solenoid 32 is de-energized causing the switching plate 31 to be returned to the initial position as illustrated. Now coins inserted are supplied again to the hopper 5.

Figure 2:
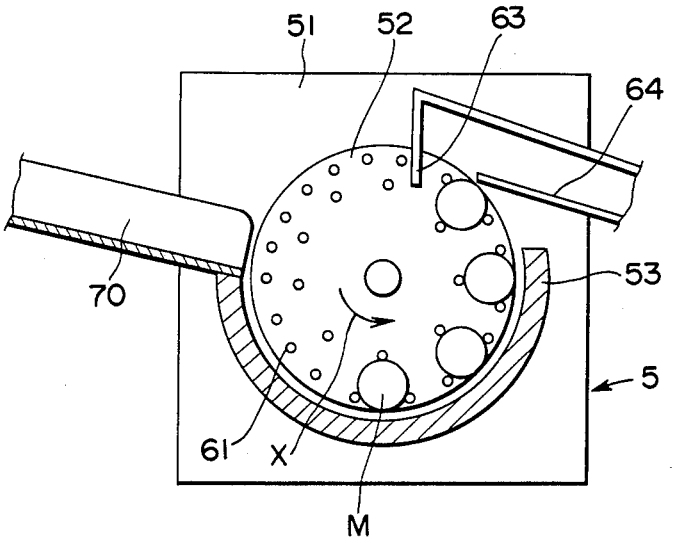
FIG. 2 is a front view, on an enlarged scale, showing an embodiment of the invention with a hopper member shown in section and electrodes omitted.
Figure 3:
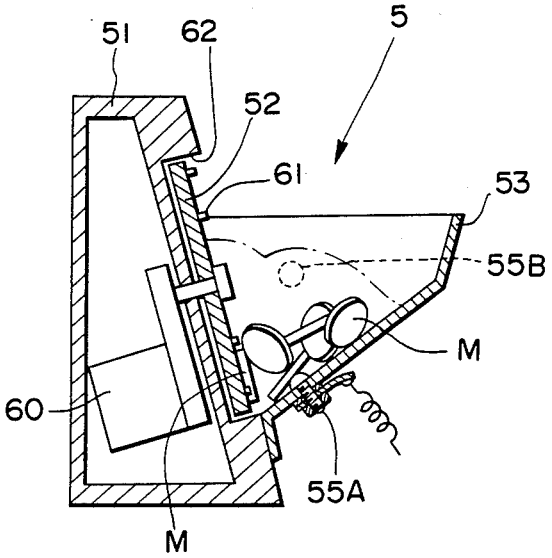
FIG. 3 is a sectional view showing the embodiment of FIG. 2.

FIGS. 2 and 3 show an embodiment of the invention. FIG. 2 is a front view, and FIG. 3 is a sectional view. The hopper 5 includes a support member 51, a scooping disc 52, a hopper member 53 made of an insulating material, an electrode 55A (for instance a positive electrode) and another electrode 55B (for instance a negative electrode), these electrodes being mounted in the hopper member 53. Coins are collected in the hopper member 53 such that they are inclined with respect to the support member 51. As the scooping disc 52 is rotated by a motor 60 in the direction of arrow X, the collected coins are brought upwards by pins 61 projecting from the scooping disc 52 at a predetermined spacing and a circular recess 62 formed in the support member 51 so that they can be brought by a guide member 63 one by one into a pay-out passage 64 leading to a coin outlet. Reference numeral 70 designates a chute for leading coins into the hopper member 53.

The electrode 55A is mounted in the hopper member 53 substantially in the lowermost position thereof such that its contact projects into the interior of the hopper member 53. The other electrode 55B, the contact of which also projects into the interior of the hopper member 53, is mounted in the hopper member in a portion thereof at a level higher than the lowermost portion noted above. When the amount of coins collected in the hopper member 53 is increased to an extent as shown by the phantom line in FIG. 3, the two electrodes 55A and 55B are electrically connected to each other since the coins M in the hopper member 53 have conductivity and are in contact with one another. When the amount becomes less than the illustrated amount, the two electrodes are electrically disconnected from each other. Thus, whether the amount of collected coins has reached a predetermined value (corresponding to the position of the electrode 55B) can be determined from whether the two electrodes 55A and 55B are electrically connected or disconnected. A conduction signal obtained in this way may be used for display and also as a signal for driving the solenoid 32 in FIG. 1. The position of the electrode 55B may be suitably determined by taking the capacity of the hopper meber 53 and other factors into consideration. The electrode 55B can be mounted in the hopper member 53 by merely forming a mounting hole therein. It is thus possible to form a plurality of mounting holes at positions of different levels and mount the electrode 55B in a suitable selected one of these mounting holes corresponding to a desired amount of accommodated coins, upon the reaching of which the detection signal is to be emitted.

Figure 4:
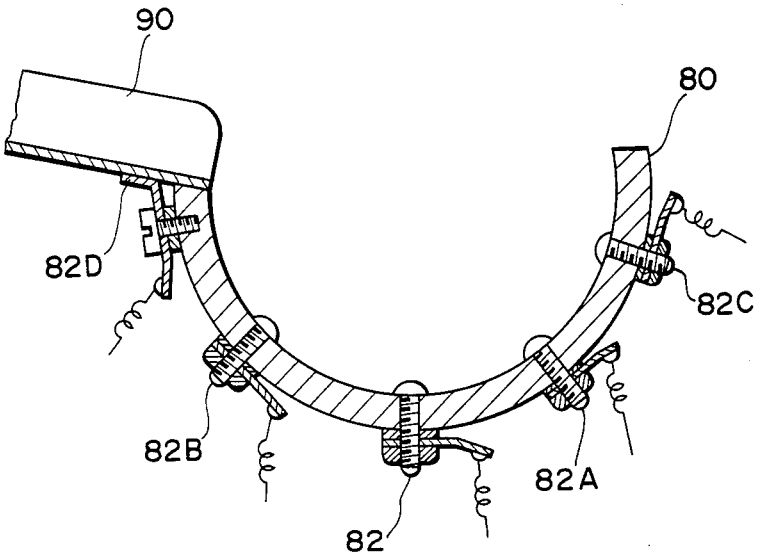
FIG. 4 is a sectional view, on an enlarged scale, showing an essential part of a different embodiment of the invention
Figure 5:
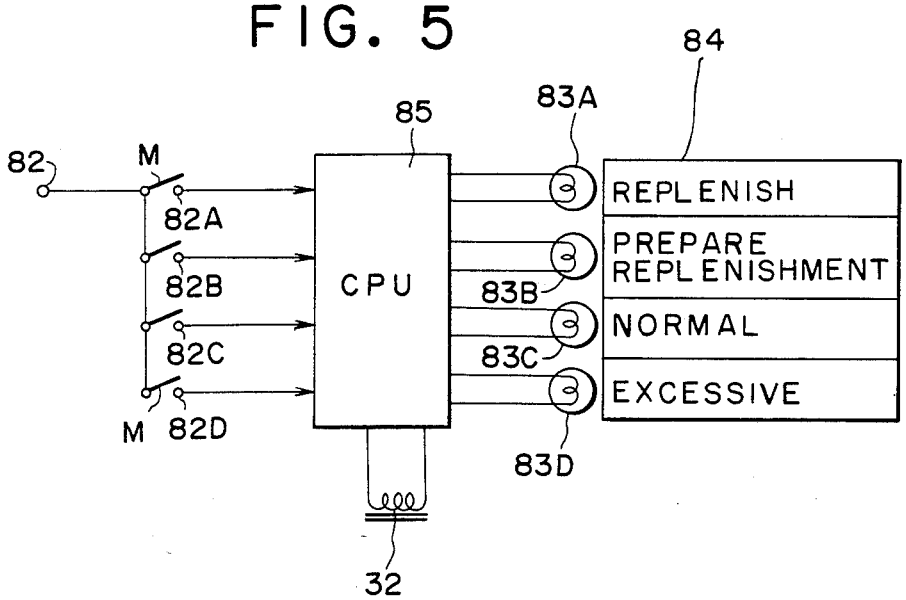
FIG. 5 is a view showing an example of the display device used with the embodiment of FIG. 4.

FIG. 4 shows a different embodiment of the invention. In this instance, an electrode 82 is mounted in hopper member 80 in the lowermost portion thereof, and other electrodes 82A to 82D are mounted in the hopper member in portions thereof at different levels. Reference numeral 90 designates a chute for leading coins into the hopper member 80. It is made of a conductive material such as iron, and the electrode 82D is in contact with it. FIG. 5 shows the principles of an example of a detecting section making use of the electrodes shown in FIG. 4. A microcomputer 85 controls the driving of display lamps 83A to 83D. A display panel 84 is illuminated by these lamps. It has display characters as shown, for instance, which are related to the amount of coins in the hopper member 80.

With this construction, the electrode 8 is connected to one or more of the other electrodes (for instance three electrodes, i.e., the electrode 82C and electrodes 82A and 82B at a lower level) according to the amount of coins accommodated in the hopper member 80. A conduction signal thus obtained is fed to the microcomputer 85. When a plurality of signals are simultaneously fed to it, the microcomputer 85 turns on a display lamp corresponding to the elctrode at the position of the lowest level (in this example the lamp 83C corresponding to the electrode 82C). In this case, a "NORMAL" display of the display panel illuminated. When the collected coins are increased beyond the level of the electrode 82C so that their level eventually reaches the chute 90, the electrode 82 is electrically connected to the electrode 82D. At this time, a display 83D shown in FIG. 5 is turned on to designate an "EXCESSIVE" amount of coins beyond the hopper capacity. At the same time, an alarm sound may, if necessary, be produced. Furthermore, the relay 32 is driven to switch the switching plate 31 to lead subsequently inserted coins to the cash box 6.

The display device shown in FIG. 5 using the microcomputer 85 is by no means limitative, and the amount of coins in the hopper member may be displaid analogwise, for instance with such an arrangement that display lamps for "on" electrodes are turned on simultaneously.

What is claimed is:

1. In a hopper device having a rotatable scopping disc for scooping up collected coins having conductivity one by one; the improvement comprising:

an insulating hopper member for accommodating coins;

a first electrode mounted in said hopper member in a lower portion thereof;

a second electrode mounted in said hopper member in a portion thereof at a level higher than the level of said first electrode, said second electrode being of opposite polarity from said first electrode and electrically to said first electrode to complete an electrical circuit between said electrodes and through a plurality of conductive coins accommodated in said hopper member to produce a detection signal indicative of the amount of accommodated coins.

2. The hopper device according to claim 1, wherein said second electrode is mounted in one of a plurality of electrode mounting sections formed in said hopper member in portions thereof at different levels.

3. The hopper device according to claim 2, wherein said electrode mounting sections are holes.

4. In a hopper device having a rotatable scooping disc for scooping up coins having conductivity accommodated in an insulating hopper member one by one, a device used with said hopper device for detecting the amount of coins accomodated in said hopper member comprising:

a first electrode mounted in said hopper member in a lowermost portion thereof;

a second electrode mounted in said hopper member in a portion thereof at a level higher than the level of said first electrode;

a conductive chute provided on top of said hopper member for replenishing said hopper member with coins;

a third electrode provided in the proximity of the outlet end of said chute; and means for causing a detection signal to be generated from said third electrode provided at a higher level than said second electrode in preference to a detection signal from said second electrode when said second and third elctrodes are simultaneously electrically coupled to said first electrode through a plurality of coins accomodated in said hopper member.

5. The device according to claim 2, which further comprises:

first display means for displaying the necessity of replenishing with coins; and second display means for displaying that the capacity of the hopper device is reached by coins;

said first and second display means being connected to said preference signal generation means;

said first display means being driven by said preference signal generation means when said first electrode is electrically coupled to said second electrode, said second display means being driven by said preference signal generation means when said first electrode is simultaneously electrically coupled to said second and third electrodes.

6. The device according to claim 5, which further comprises a solenoid driven simultaneously with said second display means and a switching plate provided in an intermediate portion of said chute and driven to a position in which coins are no longer led to said hopper member, when said solenoid is energized.

7. The device according to claim 6, wherein said display means are constituted by lamps and a display panel with display characters and adapted to be illuminated by said lamps from the back side.

* * * * *